United States Patent [19]

Yang et al.

[11] 4,250,015

[45] Feb. 10, 1981

[54] MECHANOCHEMICAL HYDROGENATION OF COAL

[75] Inventors: Ralph T. Yang, Tonawanda; Robert Smol, East Patchogue; Gerald Farber, Elmont, all of N.Y.; Leonard M. Naphtali, Washington, D.C.

[73] Assignee: The United States of America as represented by the United States Department of Energy, Washington, D.C.

[21] Appl. No.: 970,841

[22] Filed: Dec. 18, 1978

[51] Int. Cl.[3] ..... C10G 1/08; C10B 53/08; C10B 21/00; C10B 1/06

[52] U.S. Cl. ..... 208/10; 201/7; 202/100; 202/136; 241/170; 241/179; 241/65; 241/66; 422/209; 422/208; 422/309

[58] Field of Search ..... 201/7; 208/10; 202/100, 202/136; 241/170, 179, 65, 66; 422/209, 208, 309

[56] References Cited

U.S. PATENT DOCUMENTS

| | | | |
|---|---|---|---|
| 547,801 | 10/1895 | Otte | 241/65 |
| 1,296,367 | 3/1919 | Cochran | 241/170 |
| 1,506,188 | 8/1924 | McLaughlin et al. | 202/136 |
| 1,712,082 | 5/1929 | Kopper | 241/170 |
| 1,919,108 | 7/1933 | Harrison et al. | 208/10 |
| 1,945,530 | 2/1934 | Karriok | 202/136 X |
| 2,038,599 | 4/1936 | Pier et al. | 208/10 |
| 2,388,642 | 11/1945 | Ostergaard | 422/209 X |
| 4,119,699 | 10/1978 | Kellerwessel et al. | 423/109 |

OTHER PUBLICATIONS

Catalog No. 372, Patterson Pebble and Ball Mills, The Patterson Foundry and Machine Company, East Liverpool, Ohio, p. 20.

*Primary Examiner*—Delbert E. Gantz
*Assistant Examiner*—William G. Wright
*Attorney, Agent, or Firm*—James E. Denny; Richard G. Besha; Leonard Belkin

[57] ABSTRACT

Hydrogenation of coal is improved through the use of a mechanical force to reduce the size of the particulate coal simultaneously with the introduction of gaseous hydrogen, or other hydrogen donor composition. Such hydrogen in the presence of elemental tin during this one-step size reduction-hydrogenation further improves the yield of the liquid hydrocarbon product.

11 Claims, 2 Drawing Figures

TAKEN AT POINT 2-2

MECHANOCHEMICAL HYDROGENATION OF COAL

FIELD OF THE INVENTION

This invention relates to the conversion of carbonaceous solids into desirable liquid hydrocarbons. Specifically this invention relates to an improved process of converting the coal with the use of mechanical force.

BACKGROUND OF THE INVENTION AND DISCUSSION OF THE PRIOR ART

This invention was made under, or during, the course of a contract with the United States Department of Energy.

The conversion of coal, specifically by hydrogenation, results in valuable liquid hydrocarbons.

In the prior art of coal hydrogenation, extensive use was made of metal salts as a catalyst. Nelson U.S. Pat. No. 3,488,278, granted Jan. 6, 1970, suggests the use of compounds of certain metals as catalysts. Although these metal compounds, specifically chloride salts, successfully promoted the reaction, they also reacted corrosively with the equipment and apparatus. The problem sought to be alleviated by the prior art, was that of achieving the highest yield of the desirable hydrocarbons without the concommitant corrosion. Aldridge et al, U.S. Pat. No. 4,077,867, granted Mar. 7, 1978, also suggests the use of metal salts as catalysts. Johnson, U.S. Pat. No. 4,032,428, granted June 28, 1977, recommends compounds of metals.

Coal hydrogenation has formerly been achieved in multi-step processes. Nelson, U.S. Pat. No. 3,488,278 suggests grinding the coal as a precursor step in a two-step liquid slurry-extraction process. Nelson's process requires two steps because it does not apparently fully recognize the potential of mechanical energy in the hydrogenation of coal.

Now provided by the present invention is an improved method of hydrogenation of coal, which eliminates the need for the use of corrosive catalysts, while providing an improved yield of the desired liquid hydrocarbons in effectively a one-step process.

It is therefore an object of this invention to provide a method for the improved conversion of coal into liquid hydrocarbons.

It is another object of this invention to provide a method for an improved yield of liquid hydrocarbons from the conversion of coal.

It is another aspect of this invention to provide a method for coal conversion as aforesaid, wherein the need for using corrosive hydrogenation catalysts is eliminated.

It is another aspect of this invention to provide a method for coal conversion as aforesaid, wherein it is achieved in one step.

It is another aspect of this invention to provide a method for coal conversion as aforesaid, wherein the need for a solvent hydrogen donor is eliminated.

It is another aspect of this invention to provide a method for coal conversion as aforesaid, wherein it is achievable under moderate condition of temperature and pressure.

The aforesaid as well as other objects and advantages of the present invention will become apparent from a reading of the following specification, the adjoined claims, and the accompanying drawings in which:

FIG. 1 is a schematic diagram of the size reduction-hydrogenation apparatus; and FIG. 2 is an enlarged sectional view of the grinding mechanism taken along line 2—2 of FIG. 1.

DESCRIPTION OF THE PREFERRED EMBODIMENT

One preferred embodiment of the present invention may be broadly stated as a method of hydrogenating coal to form liquid hydrocarbons which comprises simultaneous size reduction of the coal in the presence of gaseous hydrogen. Under conditions of elevated temperature and pressure the fine particulate coal undergoes reaction with the hydrogen. Without wishing to be bound by any theory or mechanism, it is believed that the carbon molecules in the plane of shearing are activated by the mechanical energy at the shear sites and are thus highly susceptible to reaction, particularly so when gaseous hydrogen blankets such newly formed shear sites.

In another preferred aspect of the present invention, coal undergoes size reduction in the presence of a hydrogen donor while also having limited quantities of elemental tin present. It was surprisingly found that 0.1 to 10.0% elemental tin (based on the weight of coal) would enhance the coal hydrogenation. Such tin catalyzed hydrogenations produced, not only increased yields of hydrocarbons, but also produced higher weight percentages of the lighter hydrocarbons such as the commercially valuable benzene and toluene. Particularly desirable light liquid hydrocarbons are those having molecular weights below approximately 250. It is to be borne in mind that the elemental tin under the process conditions of the present invention achieves comparable, if not better, levels of hydrogenation than those achieved with prior art catalysts such as tin chloride, while eliminating the corrosive character of the prior art catalysts.

The hydrogenation of the present invention occurs at elevated temperatures and pressures. The temperature of the reactant hydrogen is desirably above about 100° C. and preferably between 250° C. and 550° C. and most preferably 400° C. to 500° C. Reaction pressures for the hydrogen are desirably above 100 psig and preferably 400 psig to 1200 psig and higher if so desired.

To achieve the afore-described method, the apparatus as shown in the accompanying drawings may be employed as is more fully described hereinbelow.

Figure 1:
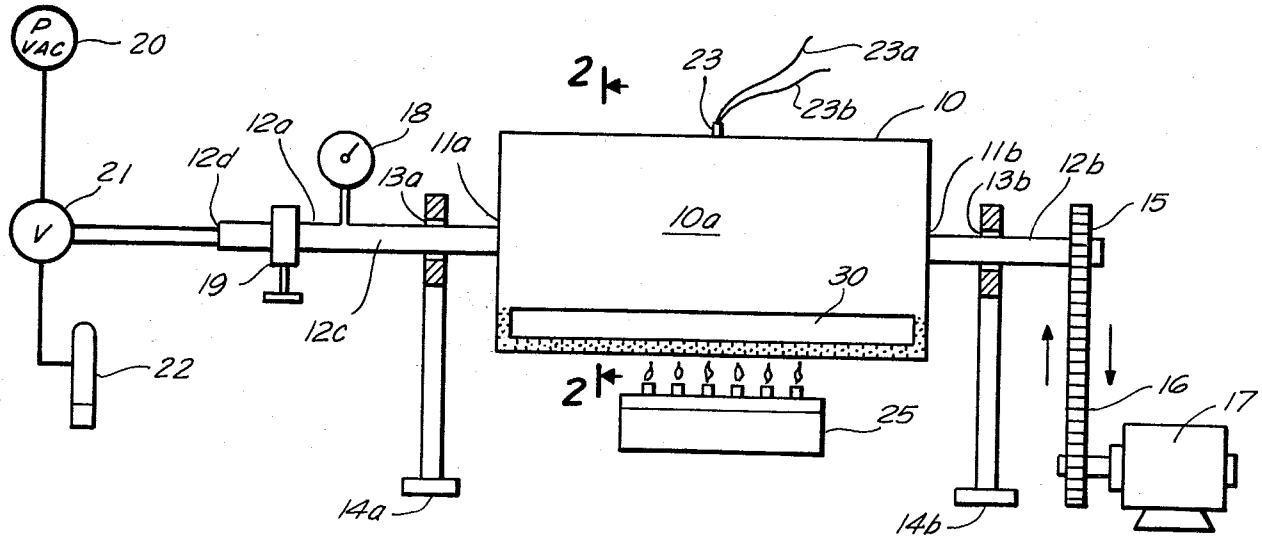
Figure 2:
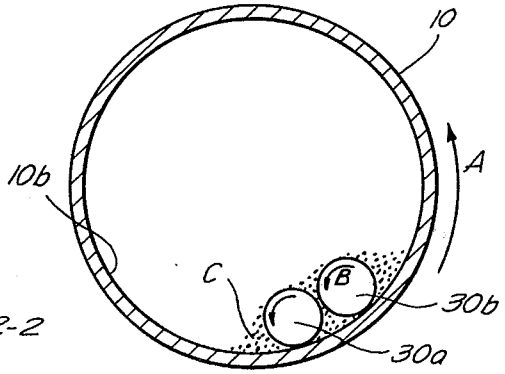

Referring to FIG. 1 there is shown a horizontally disposed cylindrical metal autoclave or chamber 10 having axles 12*a* and 12*b* respectively extending outwardly from ends 11*a* and 11*b* respectively. Axles 12*a* and 12*b* are rotatably mounted within bearings 13*a* and 13*b* respectively, which bearings are fixedly supported by stanchions 14*a* and 14*b* respectively. Axle 12*b* is mounted within gear 15 which interengages chain drive 16 which is in turn driven by motor 17. In this manner of construction, chamber 10 is rotated in the direction of arrow A as shown in FIG. 2.

Axle 12*a* is of hollow construction to form a fluid conduit 12*c* and communicates with chamber interior 10*a*. A pressure gauge 18 and gas valve 19 are operatively associated with the end 12*d* of conduit 12*c* which may be connected to either a vacuum pump 20, or alternatively through valving 21, to a hydrogen gas feed 22.

A thermocouple 23 is imbedded in chamber 10, and the leads of which are connected to a slip-ring commutator so as to permit continuous temperature signal input during rotation of chamber 10. The thermocouple leads 23*a* and 23*b* are in turn connected to a continuous recorder and may also be connected to automatic temperature control element for regulating the heat input to chamber 10. Specifically a gas-fired burner 25 is disposed below chamber 10 and is juxtaposed to the cylindrical chamber wall so that heat from the burner 25 rapidly heats the contents of the chamber interior 10*a*. The thermocouple leads may be connected through well-known control elements (not shown) to regulate the burner flame on a continuous basis.

Chamber 10 is also provided with access means (not shown) to initially feed a measured quantity of coal to the chamber interior 10*a*. A pair of cylindrical metal solid rods 30 are disposed within chamber 10 of parallel disposition so that the axes of the rods are parallel to the axis of the chamber. With the rotation of chamber 10 in the direction of arrow A, such chamber rotation imparts a rotational reaction force to rods 30 as shown by arrows B in FIG. 2. Coal particulates C are thus engaged between the rotational surfaces of rods 30 and inside chamber wall 10*b* which causes a grinding or shearing actions on the coal particulates C thereby resulting in a size reduction.

Several experiments were conducted employing the foregoing apparatus. Experiments were conducted for hydrogenation with simultaneous grinding, hydrogenation without simultaneous grinding, and additionally, grinding was combined with 1% tin to determine the effect this would have on the % yield of desired hydrocarbons. The fourth experiment conducted was using the catalyst $SnCl_2$ without any grinding, in order to compare these results with that obtained with this invention. After two hours the size of the coal was substantially the same in each of these four experiments. The reaction products were contained in 4 fractions: solid, oil, light liquid and gas.

EXPERIMENTAL EXAMPLE I

A coal sample (20 g.) was out-gassed to $10^{-3}$ Torr for 15 hours, and then $H_2$ gas was admitted to 400 psig.

At this point rotation (50 RPM) and heating was begun and continued for 2 hours. Pressure was maintained at a constant 1000 psig and the temperature was maintained at 442° C.

This figure of 442° C. represents the gas temperature within the chamber; the chamber wall temperature was 100° C. higher. Hereafter all temperature readings will refer to the gas temperature within the chamber. Heat of friction from grinding was calculated and determined to be too slight a temperature to alter results.

To obtain the reaction products, the chamber was cooled from 442° C. to 25° C. by an air blower. The resultant gas was slowly pumped through a liquid nitrogen trap and then emitted to the atmosphere. The liquid nitrogen trap is filled with steel wool, leaving a free volume of 350 $cm^3$. The contents of the trap were then obtained by first heating and then freezecondensing them into a glass flask with a cold finger on the bottom. The pressure in the flask was raised to about 200–500 Torr by warming the cold finger, resulting in the gas and light liquid products.

The coal remaining in the autoclave was leached with benzene and stirred in a beaker at 25° C. for 24 hours. This is filtered, and the solid residue is again filtered through a fine-fritted gas filter. The solid, subsequently dried at $10^{-3}$ Torr pressure and room temperature to a constant weight, is the solid fraction.

The benzene solution is evaporated at room temperature until a tarry residue of steady weight remains. This is the oil fraction.

The % yield at the hydrogenation products with simultaneous grinding were: 11.31 oil, 1.17 light liquid, 2.14 gas, 85.38 solid.

Each of these fractions were analyzed and were determined to have the following composition (as compared to the composition of the coal sample):

| Wt. % | C | H | N | S | O | Mol wt. |
|---|---|---|---|---|---|---|
| Coal | 81.50 | 2.93 | 1.19 | 1.10 | 6.57 | |
| Solid | 79.09 | 2.77 | 1.09 | 0.90 | 3.18 | |
| Oil | 90.38 | 5.60 | 1.41 | 0.61 | 1.60 | 310 |

| Mole % | $C_2H_6$ | $C_3H_8$ | $C_6H_6$ | $H_2O$ | $CH_4$ | Toluene | $C_3^+$ | $CO_2$ |
|---|---|---|---|---|---|---|---|---|
| Gas | 83.3 | 5.0 | 7.0 | 4.4 | 0.15 | 0.2 | — | — |

Light liquid, consisted of 2 layers of which the aqueous layer constituted roughly 0.3 to 0.7 of the total liquid. The amount of water contained was estimated by assuming all the oxygen removed from the original coal sample used was converted to water. Since a comparison of the oxygen content of the oil and solid fractions is roughly half that of the oxygen amount in the original sample, this left approximately ½ to have reacted to form water. The amount of water formed would be 3% by weight of the coal, indicating that the amount of light liquid in excess of 3% would be hydrocarbons. Infrared analysis reveals strong bands of benzene and toluene.

EXPERIMENTAL EXAMPLE II

The same procedure was employed as in Example 1 with the addition of 1% tin (by weight based on weight of coal). The combination of grinding with tin resulted in the following % yield: 3.14 oil, 7.41 light liquid, 3.41 gas and 86.04 solid.

Analysis of the products revealed:

| Wt. % | C | H | N | S | O | Mol. Wt. |
|---|---|---|---|---|---|---|
| Coal | 81.50 | 2.93 | 1.19 | 1.10 | 6.57 | |
| Solid | 86.47 | 2.66 | 1.39 | 0.94 | 3.82 | |
| Oil | 92.00 | 5.24 | 1.38 | 0.49 | 0.73 | 242 |

| Mole % | $C_2H_6$ | $C_3H_8$ | $C_6H_6$ | $H_2O$ | $CH_4$ | Toluene | $C_3^+$ | $CO_2$ |
|---|---|---|---|---|---|---|---|---|
| Gas | 83.4 | 5.0 | 7.2 | 2.0 | 2.30 | 0.15 | 0.08 | — |

This example demonstrates that the addition of tin to the size reduction increases the production of lighter fractions, i.e. gas and light liquid products.

EXPERIMENTAL EXAMPLE III

The coal sample was outgassed to $10^{-3}$ Torr for 15 hours and ground in helium at room temperature for 2 hours. Following this, the same procedure was employed as in Example I except that the grinding rods were not placed in the autoclave. The % yield of hydrogenation products were: 2.80 oil, 3.31 light liquid, 2.16 gas and 91.73 solid.

Analysis showed the following composition:

| Wt. % | C | H | N | S | O | Mol. Wt. |
|---|---|---|---|---|---|---|
| Coal | 81.50 | 2.93 | 1.19 | 1.10 | 6.57 | |
| Solid | 90.40 | 2.82 | 1.31 | 0.80 | 3.44 | |
| Oil | 91.35 | 5.30 | 2.12 | 0.67 | 0.60 | 323 |

-continued

| Mole % | $C_2H_6$ | $C_3H_8$ | $C_6H_6$ | $H_2O$ | $CH_4$ | Toluene | $C_3^+$ | $CO_2$ |
|---|---|---|---|---|---|---|---|---|
| Gas | 77.7 | 11.4 | 6.5 | 3.4 | 0.09 | 0.4 | .56 | — |

This example demonstrates that the absence of simultaneous grinding results in a significantly reduced oil fraction.

EXPERIMENTAL EXAMPLE IV

The same procedure was employed as in Example III. The chamber was rotated without the grinding bars but the $SnCl_2$ catalyst was added to yield the following % hydrogenation products: 1.97 oil, 7.52 light liquid, 3.64 gas and 86.87 solid.

The products were analyzed as follows:

| Wt. % | C | H | N | S | O | Mol. wt. |
|---|---|---|---|---|---|---|
| Coal | 81.50 | 2.93 | 1.19 | 1.10 | 6.57 | |
| Solid | 86.24 | 2.79 | 1.30 | 1.32 | 4.12 | |
| Oil | 91.39 | 5.34 | 1.32 | 0.76 | 0.92 | 265 |

| Mole % | $C_2H_6$ | $C_3H_8$ | $C_6H_6$ | $H_2O$ | $CH_4$ | Toluene | $C_3^+$ | $CO_2$ |
|---|---|---|---|---|---|---|---|---|
| Gas | 83.6 | 12.2 | 1.6 | 1.1 | 0.14 | 0.14 | 0.19 | 0.7 |

This example demonstrates that the $SnCl_2$ catalyst results in a similar yield as that produced by size reduction in combination with tin.

Anthracitic, bituminous and subbituminous coal, lignitic materials, and other types of coal products referred to in ASTM D-388 are exemplary of the solid carbonaceous materials which can be treated in accordance with the process of the present invention to produce upgraded products therefrom. Carboniferous materials, such as oil shale and tar sands, can also be treated herein in place of the solid carbonaceous materials to obtain similar liquid hydrocarbons. When a raw coal is employed in the process of the invention, most efficient results are obtained when the coal has a dry fixed carbon content which does not exceed 86 percent and a dry volatile matter content of at least 14 percent by weight as determined on an ash-free basis. The coal, prior to use in the process of the invention, is preferably ground in a suitable attrition machine, such as a hammermill, to a size such that at least 50 percent of the coal will pass through a 40-mesh (U.S. Series) sieve. The ground coal is then dissolved or slurried in a suitable solvent. If desired, the solid carbonaceous material can be treated, prior to reaction herein, using any conventional means known in the art, to remove therefrom any materials forming a part thereof that will not be converted to liquid herein under the conditions of reaction.

It is to be borne in mind that the process of this invention broadly contemplates size reduction of coal by any desirable means and is not to be limited specifically to the grinding as heretofore described. Size reduction by ball-mills, hammer-mills, agitation as well as other means, is also within the contemplation of this invention.

As previously stated this invention contemplates the use of gaseous hydrogen in one aspect of the invention. However, it is understood that other hydrogen donor compositions may be employed. Hydrogenation aromatics, naphthenic hydrocarbons, phenolic materials and similar compounds and will normally contain at least 30 wt. %, preferably at least 50 wt. % of compounds which are known to be hydrogen donors under the temperature and pressure conditions employed in the hydroconversion (i.e. liquefaction). Other hydrogen-rich solvents may be used instead of or in addition to such coal derived liquids. Suitable aromatic hydrogen donor solvents include hydrogenated creosote oil, hydrogenated intermediate product streams from catalytic cracking of petroleum feedstocks, and other coal-derived liquids which are rich in indane, $C_{10}$ to $C_{12}$ tetralins, decalins, biphenyl, methylnaphthalene, dimethylnaphthalene, $C_{12}$ and $C_{13}$ acenaphthenes and tetrahydroacenaphthene and similar donor compounds.

Thus while in one aspect the present invention shows improvement by the use of gaseous heated hydrogen, in other aspects such as employing the elemental tin catalyst, other hydrogen donor materials including hydrogen donor solvents are broadly contemplated.

While the apparatus of the present invention was of steel construction, one skilled in the art would recognize the usefulness of other materials of construction. And it is further recognized that such apparatus and method as aforedescribed achieves a one-step direct hydrogenation of particulate coal, without the need for several apparatus in a series of complex process reaction as was common in the prior art.

Obviously, many modifications and variations of the invention, as hereinabove set forth, can be made without departing from the spirit and scope thereof, and therefore only such limitations should be imposed as are indicated in the appended claims.

What is claimed is:

1. A method for the hydrogenation of coal comprising applying a force to coal particulates to reduce the size of the particulate coal in contact with elemental tin catalyst and a hydrogen donor to form hydrocarbons.

2. The method of claim 1, wherein the hydrogen donor comprises gaseous hydrogen.

3. The method of claim 1, wherein the hydrogen donor comprises a liquid.

4. The method of claim 1, further comprising heating the hydrogen donor.

5. The method of claim 1, wherein reducing the size of particulate coal occurs after providing the elemental tin.

6. The method of claim 1, wherein the reducing of the size of the particulate coal occurs simultaneously with the contact with the elemental tin.

7. The method of claim 1, wherein the tin is present in an amount of from 0.1% to 10% by weight of the coal.

8. The method of claim 2, wherein the hydrogen is maintained at pressures above about 100 psig during hydrogenation.

9. The method of claim 4, wherein the temperature of the hydrogen donor is 250° C. to 650° C.

10. The method of claim 8, wherein the hydrogen pressure is 400 to 1200 psig.

11. The method of claim 7, wherein the tin is present as 1% by weight of the coal.

* * * * *